US005929394A

United States Patent [19]

Westerbeke, Jr.

[11] Patent Number: 5,929,394

[45] Date of Patent: Jul. 27, 1999

[54] SOUND ENCLOSURE

[75] Inventor: John H. Westerbeke, Jr., Milton, Mass.

[73] Assignee: Westerbeke Corporation, Avon, Mass.

[21] Appl. No.: 08/946,037

[22] Filed: Oct. 7, 1997

[51] Int. Cl.[6] ..... F01N 1/10

[52] U.S. Cl. ..... 181/204; 181/202

[58] Field of Search ..... 181/200, 201, 181/202, 204; 52/264, 265, 270, 284, 79.1, 79.5, 79.9, 79.12

[56] References Cited

U.S. PATENT DOCUMENTS

| | | | |
|---|---|---|---|
| 3,534,828 | 10/1970 | Iver et al. . | |
| 3,729,889 | 5/1973 | Baruzzini | 52/264 |
| 3,924,597 | 12/1975 | Hatz et al. . | |
| 4,120,376 | 10/1978 | Palmer . | |
| 4,381,632 | 5/1983 | Geitner | 52/264 |
| 4,454,694 | 6/1984 | Davanture . | |
| 4,493,390 | 1/1985 | Pagano et al. . | |
| 4,649,667 | 3/1987 | Kitograd . | |
| 4,733,750 | 3/1988 | Poirier et al. . | |
| 4,836,123 | 6/1989 | Grinde et al. . | |
| 5,036,638 | 8/1991 | Kurtz, Jr. | 52/284 |
| 5,210,984 | 5/1993 | Eckel | 52/270 |

*Primary Examiner*—Khanh Dang
*Attorney, Agent, or Firm*—Fish & Richardson P.C.

[57] ABSTRACT

An enclosure for acoustically insulating noise-producing equipment, such as an engine or generator, includes a base, first and second opposing end panels, first and second opposing side panels, and a top panel. The side and end panels rest upon the base and are releasably interconnected at mitered edge joints. The top panel is releasably connected to the end and side panels at similar mitered edge joints. The top, side and end panels are each separately removable from the enclosure without removing any other of the panels, enabling unobstructed access to all sides of the enclosure equipment. Guide pins at the mitered joints align the panels. Methods of use are also disclosed.

25 Claims, 3 Drawing Sheets

SOUND ENCLOSURE

BACKGROUND OF THE INVENTION

This invention relates to enclosures for acoustically insulating sound-producing equipment.

In certain applications it is helpful to enclose a piece of noisy machinery, such as an engine or generator, with an enclosure to maintain a desired ambient noise level. The more completely enclosed the machinery, the better the sound attenuation. However, servicing the equipment is often hampered by full enclosures, the enclosure panels or other enclosure framework not allowing convenient and unobstructed access to all sides of the equipment.

SUMMARY OF THE INVENTION

The invention features an enclosure for acoustically insulating equipment enclosed thereby. The enclosure has a base, first and second opposing end panels, first and second opposing side panels, and a top panel. The side and end panels rest upon the base. The side panels are releasably connected to the end panels at mitered side edge joints, and the top panel is releasably connected to the end and side panels at corresponding mitered top edge joints. The top, side and end panels are each separately removable from the enclosure without removing any other of the panels.

In some embodiments, the enclosure includes compliant gasket material, such as a closed cell foam, held in compression in the top and side mitered edge joints.

The top, side and end panels may be fashioned of sheet metal with typical sheet metal equipment. In some configurations, the top, side and end panels each have folded edge portions that form the top and side mitered edge joints, the folded edge portions defining interior edge channels on at least three edges of each panel. The enclosure may include sound absorbing panels, such as of open cell foam, adjacent inner surfaces of the top, edge and side panels, the sound absorbing panels having edges disposed within the interior edge channels.

In some embodiments, each of the mitered edge joints defines a joint plane along which two of the top, end and side panels join in mating engagement. Each of the two joining panels may be substantially planar, the joint plane intersecting the planes of each of the joining panels at miter angles of about 45 degrees.

In some embodiments, at least one of the joining panels includes a guide pin extending through the joint plane for aligning the two joining panels. The guide pin preferably has a frustoconical tip defining an included angle of at least about 90 degrees.

In the presently preferred arrangement, the top, side and end panels each have corner pieces with two adjacent, mitered edges. The corner pieces may extend into the interior edge channels to retain them in place.

The top, end and side panels are preferably constructed to be mutually self-supporting when releasably inter-connected to form the enclosure.

The top, side and end panels may be curved near the top and side mitered edge joints, such that the enclosure has rounded edges. Besides being aesthetically pleasing, such rounded edges help to reduce the chance of sharp corner injuries.

Some embodiments include latches to hold the top, side and end panels in an inter-connected condition. Each of the latches may include an elastomeric section arranged to be stretched to maintain compressive load across one of the top and side mitered edge joints.

In some cases, the enclosure is adapted to enclose a marine propulsion system.

According to another aspect of the invention, a method of enclosing sound-producing equipment with the featured enclosure includes arranging the base and panels to enclose the sound-producing equipment.

According to yet another aspect of the invention, a method of servicing equipment enclosed within the above-described enclosure includes removing a selected one of the side, end and top panels to access the enclosed equipment, servicing the enclosed equipment, and replacing the removed panel.

The enclosure can provide advantages in equipment serviceability, as it enables full, unobstructed access to any side of the enclosed equipment. All panels are removable, and any one panel may be removed without disturbing the others. Panel removal requires no tools.

In addition, the configuration of the mitered edge joints enables compression loading in use across all joints, thus providing low transmissibility of airborne sound through the joints. This angled edge construction also allows the enclosure to be readily produced with simple metal working equipment, requiring no welding to produce the panels, and provides means for holding interior sound absorption panels in place. Other advantages will also be understood by those skilled in the art.

DESCRIPTION OF THE PREFERRED EMBODIMENT

Figure 1:
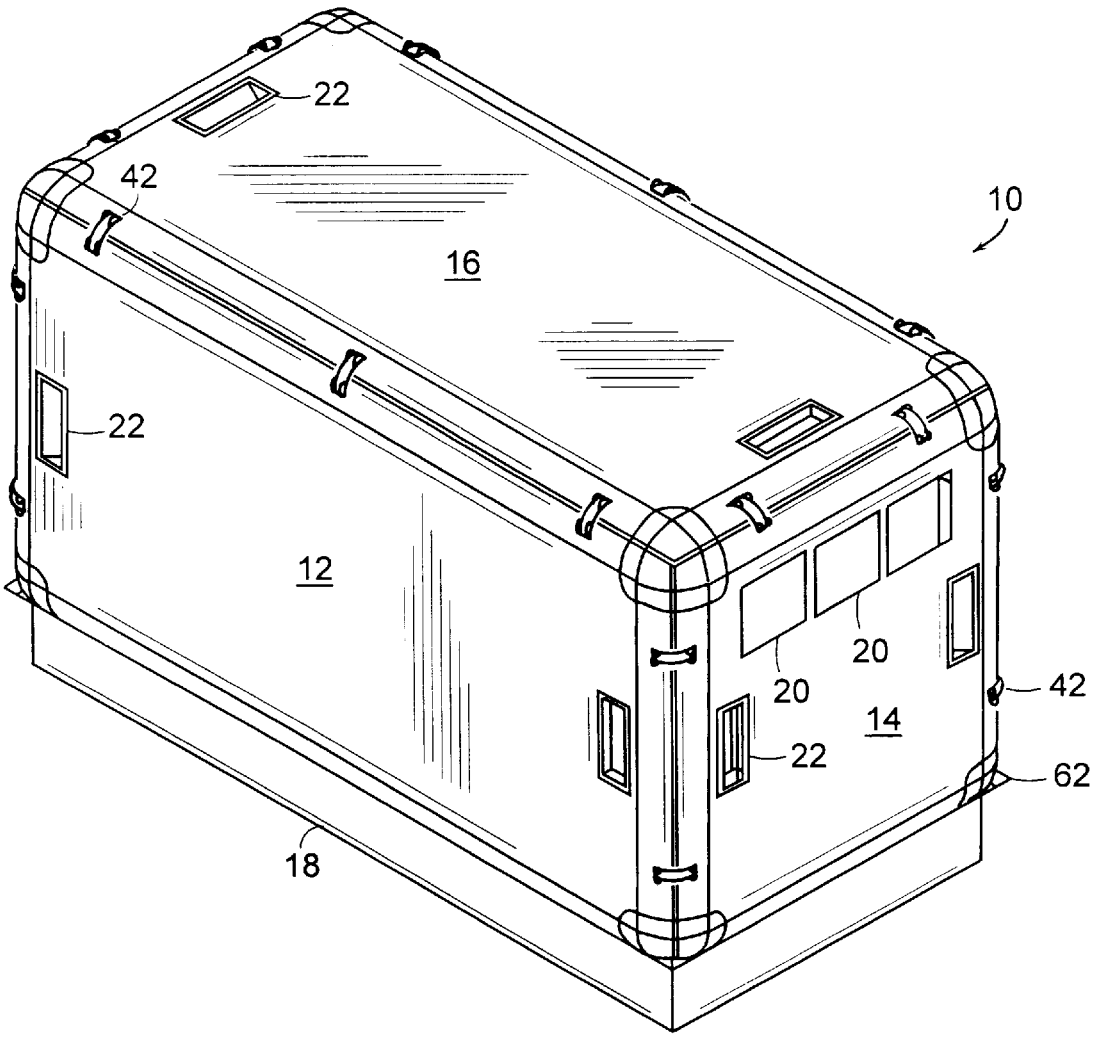
FIG. 1 is a perspective view of a sound enclosure.

Referring to FIG. 1, sound enclosure 10 includes two side panels 12, two end panels 14, a top panel 16, and a base 18. Shown fully assembled, enclosure 10 effectively surrounds and acoustically isolates sound-producing equipment, such as a gas or diesel engine and/or generator. Air circulation vents 20 are provided in end panels 14, which are preferably shrouded on the inside of the enclosure to form a labyrinth passage to reduce airborne noise through the vents, as is known in the art. Any necessary electrical and fluid lines (not shown) to and from the interior of the enclosure are preferably routed through base 18. The panels and base are 16 gauge sheet steel. Each panel 12, 14 and 16 has two opposing handles 22 and may be formed from a single piece of sheet metal, without welding or seaming, due to the construction of the edges and corners of the planar panels. Each panel includes four corner pieces 24, one at each corner.

Figure 2:
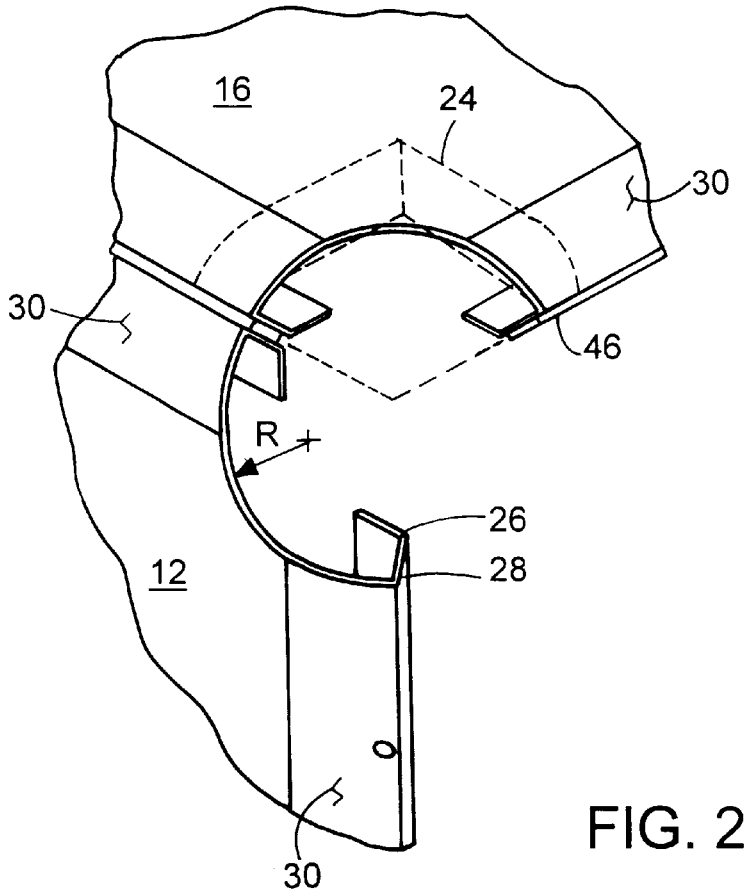
FIG. 2 is a partial cutaway view of a corner of the sound enclosure with one panel and one corner piece removed.

Referring also to FIG. 2, which shows one of the corners of enclosure 10 with end panel 14 and the corner piece of side panel 12 removed, and corner piece 24 of top panel 16 shown only in dashed outline, the panels are each bent along their edges. Each panel corner is notched, with a generous inner radius R, and the edges of the panel are then bent, as with a sheet metal brake, to form two sharp bends 26 and 28 and a gentle arc in the outer regions 30 of the panel near bends 28. The only other metal work involved in the construction of the panels is punching out holes for handles and mounting hardware (typically before bending).

Figure 3:
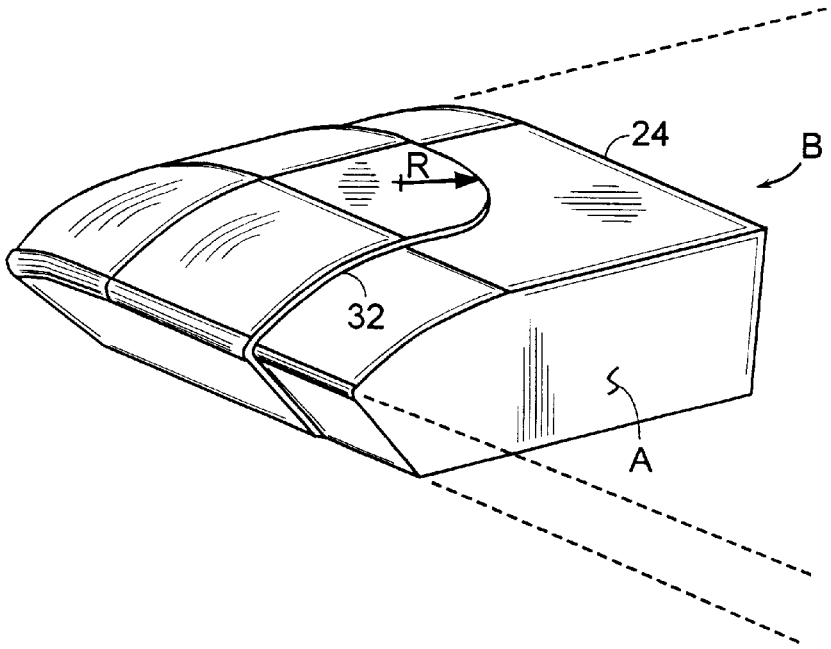
FIG. 3 is a perspective view of a corner piece.

Referring to FIG. 3, a corner piece 24 is shown in solid lines, with the outline of its corresponding sheet metal panel shown as dashed lines. Corner pieces 24 may be formed of molded plastic, such as blow-molded polyethylene. A ridge 32 of about 0.070 inch forms a lip for abutting the edges of the notched corner of the sheet metal for a smooth outer surface. Ridge 32 is radiused on the upper face of the corner piece to match the radius R of the notch. The two exposed sides of corner piece 24 are beveled at about a 45 degree angle to its upper and lower faces to match the bevels formed by bending the sheet metal panel. Each corner piece 24 is snapped into the notched corner of a panel such that sides A and B extend into the interior channels formed by the bent edges of the panel.

Figure 4:
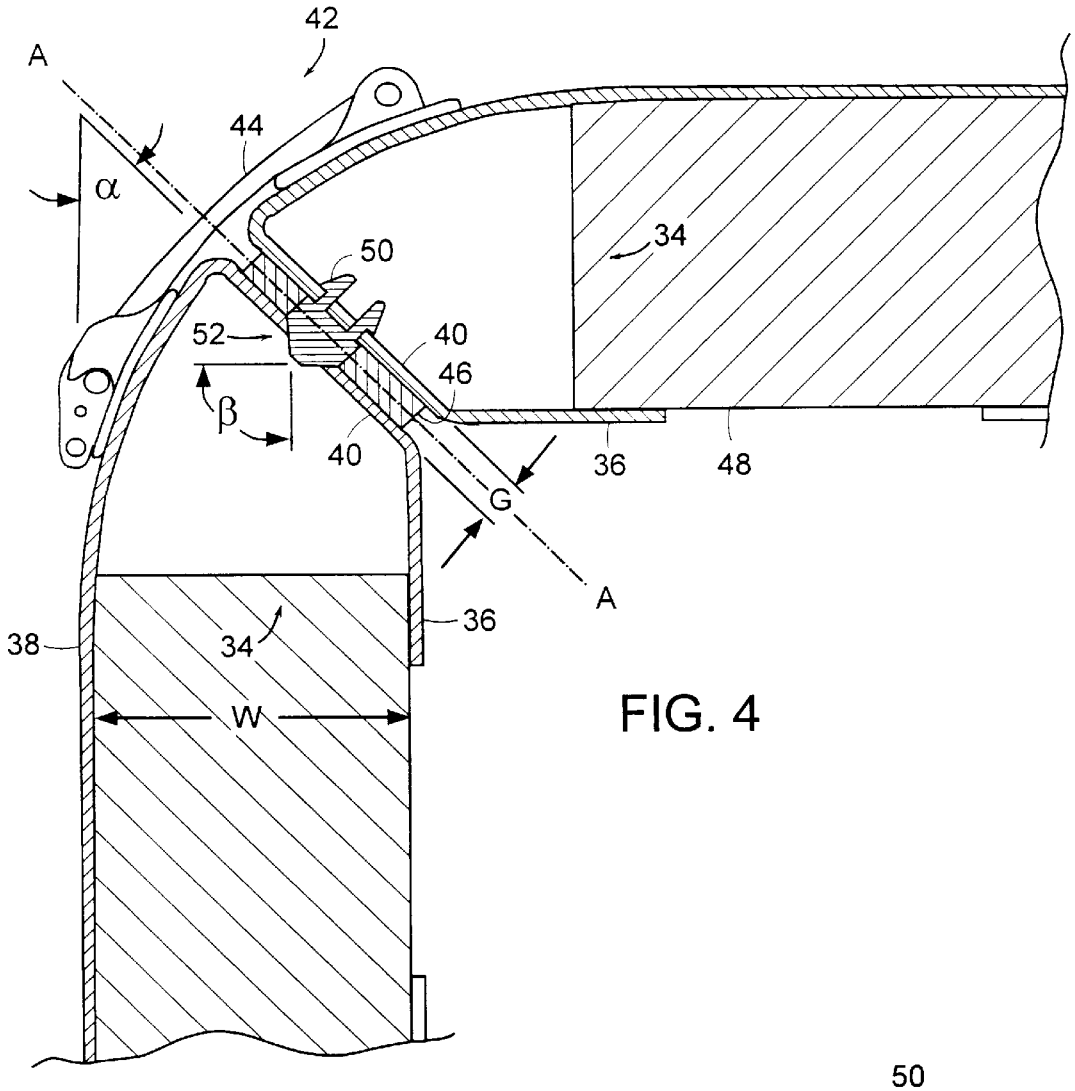
FIG. 4 is a cross-section view through an edge joint of the enclosure.

A section view through a joint between two typical panels, as assembled, is shown in FIG. 4. This figure is the same for either a side/end panel joint (a vertical joint between a side panel and an end panel) or a top panel joint (a horizontal joint between the top panel and another panel). The two panels meet at a joint plane, indicated by line A—A. The width W of the interior edge channels 34 extending along the sides of each panel between the channel lip 36 and the panel face 38 is about 0.9 inch. The bent panel edge forms a joint face 40 which is bevelled at an angle $\alpha$ of about 45 degrees to the panel face 38 (i.e., the edges of the panels are mitered). A latch 42 for holding the joint together has an elastomeric portion 44 which is stretched to keep the two panels of the joint held together with some nominal compression between their joint faces 40. Latches of this type are common as truck hood latches, for instance.

A gasket 46 is provided on one of the two joint faces 40 at each joint, to improve noise suppression. The panels are bent such that the nominal gap G at each joint is about 0.125 inch with latches 42 secured. Gasket 46 is a strip of closed cell foam, such as is commercially available as home weatherstripping, with an uncompressed thickness of about 0.188 inch. Other gasket materials may also be used, and should be compliant and have good elastomeric memory. Compressed by the load between the two panels, gasket 46 provides an effective joint seal against airborne noise radiating through the joint, and also cushions the panels against rattles.

Interior edge channels 34 retain semi-rigid sound-absorbing insert panels 48 in each sheet metal panel. Channel lips 36 overlap the edges of the insert panels to hold them in place. Spray adhesive between panel face 38 and insert panel 48 may be added for extra retention. Semi-rigid panels 48 are preferably selected from materials known to be good sound absorbers, such as open cell foams, and should be compliant enough to be deformed for insertion into channels 34.

Figure 5:
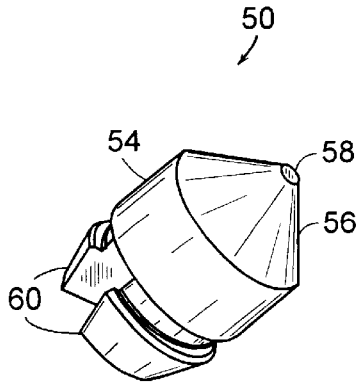
FIG. 5 is a perspective view of a guide pin.

Referring also to FIG. 5, guide pins 50 at each edge joint help to align the joining panels during assembly. Pins 50 may be molded of a polymer, such as nylon, polyacetal ("DELRIN") or polypropylene, and are designed to be snapped into place in corresponding punched holes in the joint faces 40 of the panels. Mating holes 52 are provided in joint faces 40 to receive the tapered ends of pins 50. Pins 50 have a cylindrical section 54 and a conical end 56 with a blunt tip 58 and an included tip angle $\beta$ of about 90 degrees (FIG. 4). Opposing fingers 60 with radially projecting cam surfaces provide a snap fit with the edges of the pin mounting holes. Preferably, at least two guide pins are employed per edge joint.

To remove top panel 16 from the enclosure, the latches 42 connecting the top panel to all other panels are released. Grasping handles 22 (FIG. 1), the top panel may be pulled directly upward, away from the other panels, due to conical section 56 of guide pins 50 (FIG. 5). With top panel 16 removed, the remaining panels and base retain their relation and structure, and there is no obstructing enclosure framework above the enclosed equipment to interfere with servicing the equipment. As top panel 16 is set back in place, guide pins 50 align the top panel with the side and end panels without disturbing the position of the panels already in place.

Similarly, each of the side and end panels may be individually removed without disturbing any of the other panels. Due to the small V-shaped trough 62 in which the side and end panels rest upon base 18 (FIG. 1), the top edges of the side or end panel is typically tipped outward and the panel then lifted slightly to clear the lip of trough 62. Otherwise, the removal and replacement of a side or end panel is the same as for the top panel, and provides clear access to any side of the enclosed equipment without obstruction of enclosure framing. The inner side of the V-shaped trough of the base forms a mitered edge joint with the joint faces of the bottom sides of the side and end panels.

The angled joint faces 40 (FIG. 4), in combination with compliant gasket material 46, provides good sound absorption at the enclosure joints and also allows each panel to be removed without either panel sliding across the face of the gasket. The separation at the gasket interface is therefore clean and less likely to damage the gasket material with repetition.

The enclosure shown in the figures is especially suitable for enclosing engines, generators and propulsion systems, such as in marine applications. The size and shape of the enclosure can be chosen to enclose a particular piece of equipment while applying the principles and concepts discussed above.

The base of the enclosure (e.g., 18 in FIG. 1) may have a solid center or may be an open, four-sided frame adapted to be lowered over a mounted engine. An important feature of the base is that it provide means for receiving the lower edges of the side and end panels such that the assembled enclosure fully surrounds any otherwise open sides of the equipment.

Other embodiments and features will also fall within the scope of the following claims.

What is claimed is:

1. An enclosure for acoustically insulating equipment enclosed thereby, the enclosure adapted to enclose a marine propulsion system and comprising a base;

first and second opposing end panels resting upon the base;

first and second opposing side panels resting upon the base and releasably connected to the end panels at mitered side edge joints; and a top panel releasably connected to the end panels and the side panels at corresponding mitered top edge joints;

the top, side and end panels each separately removable from the enclosure without removing any other of said panels.

2. The enclosure of claim 1 further comprising compliant gasket material held in compression in said top and side mitered edge joints.

3. The enclosure of claim 2 wherein the gasket material comprises a closed cell foam.

4. The enclosure of claim 1 wherein the top, side and end panels are each comprised of sheet metal.

5. The enclosure of claim 4 wherein the top, side and end panels each have folded edge portions that form said top and side mitered edge joints, said folded edge portions defining interior edge channels on at least three edges of each panel.

6. The enclosure of claim 5 further comprising sound absorbing panels adjacent inner surfaces of the top, edge and side panels, the sound absorbing panels having edges disposed within said interior edge channels.

7. The enclosure of claim 1 wherein each of said mitered edge joints defines a joint plane along which two of said top, end and side panels join in mating engagement.

8. The enclosure of claim 7 wherein each of said two joining panels is substantially planar, said joint plane intersecting the planes of each of said two joining panels at miter angles of about 45 degrees.

9. The enclosure of claim 7 wherein at least one of said joining panels further comprises a guide pin extending through said joint plane for aligning said two joining panels.

10. The enclosure of claim 9 wherein said guide pin has a frustoconical tip defining an included angle of at least about 90 degrees.

11. The enclosure of claim 1 wherein said top, side and end panels each have corner pieces with two adjacent, mitered edges.

12. The enclosure of claim 10 wherein the corner pieces extend into said interior edge channels.

13. The enclosure of claim 1 wherein said top, end and side panels are constructed to be mutually self-supporting when releasably inter-connected to form the enclosure.

14. The enclosure of claim 1 wherein said top, side and end panels are curved near said top and side mitered edge joints, such that the enclosure has rounded edges.

15. The enclosure of claim 1 further comprising latches to hold said top, side and end panels in an inter-connected condition.

16. The enclosure of claim 15 wherein each of said latches include an elastomeric section arranged to be stretched to maintain compressive load across one of said top and side mitered edge joints.

17. A method of enclosing sound-producing equipment, the method comprising providing a base;

placing first and second opposing end panels upon the base;

placing first and second opposing side panels upon the base;

releasably connecting the side panels to the end panels at mitered side edge joints with latches arranged to hold said side and end panels in an inter-connected condition, said latches each including an elastomeric section arranged to be stretched to maintain compressive load across one of said mitered side edge joints; and releasably connecting a top panel to the end and side panels at corresponding top edge joints with latches arranged to hold said top, side and end panels in an inter-connected condition, said latches each including an elastomeric section arranged to be stretched to maintain compressive load across one of said top edge joints;

the top, side and end panels each separately removable from the enclosure without removing any other of said panels, the base and panels arranged to enclose sound-producing equipment.

18. The method of claim 17, wherein the sound-producing equipment is a marine propulsion system.

19. A method of servicing equipment enclosed within an enclosure comprising a base;

first and second opposing end panels resting upon the base;

first and second opposing side panels resting upon the base and releasably connected to the end panels at mitered side edge joints;

a top panel releasably connected to the end panels and the side panels at corresponding mitered top edge joints; and latches to hold said top, side and end panels in an inter-connected condition, said latches each including an elastomeric section arranged to be stretched to maintain compressive load across one of said mitered top and side edge joints;

the top, side and end panels each separately removable from the enclosure without removing any other of said panels, the method comprising releasing at least one of said latches;

removing a selected one of said side, end and top panels to access the enclosed equipment;

servicing the enclosed equipment; and replacing the removed panel.

20. An enclosure for acoustically insulating equipment enclosed thereby, the enclosure comprising a base;

first and second opposing end panels resting upon the base;

first and second opposing side panels resting upon the base and releasably connected to the end panels at mitered side edge joints; and a top panel releasably connected to the end panels and the side panels at corresponding mitered top edge joints;

the top, side and end panels each separately removable from the enclosure without removing any other of said panels;

the top, side and end panels each being comprised of sheet metal and having folded edge portions that form said top and side mitered edge joints, said folded edge portions defining interior edge channels on at least three edges of each panel.

21. The enclosure of claim 20 further comprising sound absorbing panels adjacent inner surfaces of the top, edge and side panels, the sound absorbing panels having edges disposed within said interior edge channels.

22. An enclosure for acoustically insulating equipment enclosed thereby, the enclosure comprising a base;

first and second opposing end panels resting upon the base;

first and second opposing side panels resting upon the base and releasably connected to the end panels at mitered side edge joints; and a top panel releasably connected to the end panels and the side panels at corresponding mitered top edge joints;

the top, side and end panels each separately removable from the enclosure without removing any other of said panels;

each of said mitered edge joints defining a joint plane along which two of said top, end and side panels join in mating engagement; at least one of said joining panels further comprising a guide pin extending through said joint plane for aligning said two joining panels, said guide pin having a frustoconical tip defining an included angle of at least about 90 degrees.

23. The enclosure of claim 22 wherein the corner pieces extend into said interior edge channels.

24. An enclosure for acoustically insulating equipment enclosed thereby, the enclosure comprising a base;

first and second opposing end panels resting upon the base;

first and second opposing side panels resting upon the base and releasably connected to the end panels at mitered side edge joints; and a top panel releasably connected to the end panels and the side panels at corresponding mitered top edge joints;

the top, side and end panels each separately removable from the enclosure without removing any other of said panels;

said top, side and end panels being curved near said top and side mitered edge joints, such that the enclosure has rounded edges.

25. An enclosure for acoustically insulating equipment enclosed thereby, the enclosure comprising a base;

first and second opposing end panels resting upon the base;

first and second opposing side panels resting upon the base and releasably connected to the end panels at mitered side edge joints;

a top panel releasably connected to the end panels and the side panels at corresponding mitered top edge joints; and latches to hold said top, side and end panels in an inter-connected condition, said latches each including an elastomeric section arranged to be stretched to maintain compressive load across one of said top and side mitered edge joints;

the top, side and end panels each separately removable from the enclosure without removing any other of said panels.

* * * * *